US007264414B2

(12) United States Patent
McReynolds et al.

(10) Patent No.: US 7,264,414 B2
(45) Date of Patent: Sep. 4, 2007

(54) DISPENSER ASSEMBLY FOR DISPENSING LIQUID ONTO A REMOVABLE SHEET CONTAINED BY AN IMPLEMENT

(75) Inventors: Kent B. McReynolds, Racine, WI (US); Michael C. Fryan, Racine, WI (US); Douglas A. Soller, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 152 days.

(21) Appl. No.: 10/881,472

(22) Filed: Jun. 30, 2004

(65) Prior Publication Data

US 2005/0039293 A1 Feb. 24, 2005

Related U.S. Application Data

(60) Provisional application No. 60/483,104, filed on Jun. 30, 2003.

(51) Int. Cl.
*A46B 11/02* (2006.01)
*B43K 5/02* (2006.01)

(52) U.S. Cl. ..... 401/188 R; 401/136; 401/137; 401/207

(58) Field of Classification Search ..... 401/188 R, 401/196, 136, 125, 137, 139, 123, 126, 207
See application file for complete search history.

(56) References Cited

U.S. PATENT DOCUMENTS

| | | | | |
|---|---|---|---|---|
| 428,585 | A | 5/1890 | Fanning | |
| 721,112 | A | 2/1903 | Weaver et al. | |
| 804,794 | A | 11/1905 | Coan | |
| 1,610,595 | A | 12/1926 | Rudolph | |
| 1,774,409 | A | 8/1930 | Tripp | |
| 1,943,647 | A | 1/1934 | Weller | 91/54.4 |
| 2,550,393 | A | 4/1951 | Wurfschmit | 51/187 |
| 2,752,069 | A | 6/1956 | Welsh | 222/207 |
| 2,789,725 | A | 4/1957 | Carper | 221/56 |
| 2,870,475 | A | 1/1959 | Scheuer et al. | 15/231 |
| 2,994,901 | A | 8/1961 | Ely | 158/257.05 |

(Continued)

FOREIGN PATENT DOCUMENTS

DE 29612505 12/1996

(Continued)

OTHER PUBLICATIONS

Patetn Abstracts of Japan vol. 2000, No. 02, Feb. 29, 2000 & JP 11313793A (Lion Corp) Nov. 16, 1999 abstract.

*Primary Examiner*—Khoa D. Huynh

(57) ABSTRACT

A dispenser includes a cradle (2) including generally upright sidewalls (4, 6), a handle (40) having a top and a bottom, and a plurality of sheets (30) releasably attached to the bottom of the handle (40), such that the plurality of sheets (30) faces the cradle (2). The cradle (2) can house a reservoir (14) containing a liquid product. The handle (40) is positioned by the upright sidewalls (4, 6) of the cradle (2) and is supported by the cradle (2). The liquid product can be dispensed from the reservoir (14) onto the surface of the outermost sheet (50) of the plurality of sheets (30). That sheet (50) then can be used to apply the liquid product to a surface, and can be removed and discarded after use, revealing a fresh sheet.

16 Claims, 15 Drawing Sheets

U.S. PATENT DOCUMENTS

| | | | | |
|---|---|---|---|---|
| 3,328,830 | A | 7/1967 | Corwin | 15/541 |
| 3,373,457 | A | 3/1968 | Rouch | 15/104 |
| 3,703,739 | A | 11/1972 | Young et al. | 15/230.17 |
| 3,776,773 | A | 12/1973 | Taft | 134/6 |
| 3,784,998 | A | 1/1974 | Jones | 15/209 R |
| 3,796,185 | A | 3/1974 | Boone | 118/325 |
| 3,806,260 | A | 4/1974 | Miller | 401/7 |
| 3,826,259 | A | 7/1974 | Bailey | 128/269 |
| 3,865,271 | A | 2/1975 | Gold | 221/96 |
| 3,975,868 | A | 8/1976 | Botimer | 51/358 |
| 4,127,339 | A | 11/1978 | Malacheski et al. | 401/132 |
| 4,131,195 | A | 12/1978 | Worrell, Sr. | 206/205 |
| 4,140,409 | A | 2/1979 | DeVries | 401/132 |
| 4,437,271 | A | 3/1984 | McAvoy | 51/400 |
| 4,533,399 | A | 8/1985 | Mencke | 134/6 |
| 4,550,855 | A | 11/1985 | Harrison | 221/63 |
| 4,596,481 | A | 6/1986 | Tanaka | 401/132 |
| 4,667,846 | A | 5/1987 | Marceau | 221/34 |
| 4,713,274 | A | 12/1987 | Minor | 428/40 |
| 4,747,365 | A | 5/1988 | Tusch | 118/221 |
| 4,759,472 | A | 7/1988 | Strenger | 222/92 |
| 4,795,063 | A | 1/1989 | Sekiguchi et al. | 222/105 |
| 4,873,728 | A | 10/1989 | Bono | 4/233 |
| 4,937,910 | A | 7/1990 | Frazier | 15/231 |
| 4,948,078 | A | 8/1990 | Dumenigo | 248/176 |
| 5,083,337 | A | 1/1992 | Jones | 15/104.94 |
| 5,095,574 | A | 3/1992 | Khanzadian | 15/118 |
| 5,114,255 | A | 5/1992 | Villarreal | 401/45 |
| 5,140,785 | A | 8/1992 | Eleouet | 51/391 |
| 5,230,119 | A | 7/1993 | Woods et al. | 15/209.1 |
| 5,248,211 | A | 9/1993 | Holst | 401/7 |
| 5,359,738 | A | 11/1994 | Kurtz | 4/661 |
| 5,380,110 | A | 1/1995 | Festa | 401/132 |
| 5,435,465 | A | 7/1995 | El-Amin | 222/108 |
| 5,542,352 | A | 8/1996 | Blackman et al. | 101/483 |
| 5,695,293 | A | 12/1997 | Chase | 401/44 |
| 5,704,723 | A | 1/1998 | Salisian | 401/8 |
| 5,814,159 | A | 9/1998 | Paley et al. | 134/6 |
| 5,829,278 | A | 11/1998 | Koo | 68/205 R |
| 5,887,759 | A | 3/1999 | Ayigbe | 222/192 |
| 5,894,623 | A | 4/1999 | Thill | 15/104.002 |
| 5,900,068 | A | 5/1999 | Thomas | 134/6 |
| 5,922,427 | A | 7/1999 | King | 428/40.1 |
| 5,945,076 | A | 8/1999 | Leonard et al. | 422/300 |
| 6,012,572 | A | 1/2000 | Heathcock et al. | 206/233 |
| 6,026,953 | A | 2/2000 | Nakamura et al. | 206/233 |
| 6,059,882 | A | 5/2000 | Steinhardt et al. | 118/264 |
| 6,068,820 | A | 5/2000 | DeGuzman | 422/294 |
| 6,085,899 | A | 7/2000 | Thorsbakken | 206/205 |
| 6,095,709 | A | 8/2000 | Armer et al. | 401/268 |
| 6,113,271 | A | 9/2000 | Scott et al. | 383/211 |
| 6,170,426 | B1 | 1/2001 | Thorsbakken | 118/43 |
| 6,199,240 | B1 | 3/2001 | You | 15/121 |
| 6,270,275 | B1 | 8/2001 | Martz | 401/207 |
| 6,279,188 | B1 | 8/2001 | Barwin et al. | 15/104.94 |
| 6,280,111 | B1 | 8/2001 | Armer et al. | 401/118 |
| 6,298,517 | B1 | 10/2001 | McKay | 15/228 |
| 6,309,124 | B1 | 10/2001 | Gueret | 401/124 |
| 6,314,971 | B1 | 11/2001 | Schneider | 134/56 |
| 6,319,318 | B1 | 11/2001 | Pekarek et al. | 118/249 |
| 6,346,153 | B1 | 2/2002 | Lake et al. | 118/423 |
| 6,367,115 | B1 | 4/2002 | Frazier | 15/231 |
| 6,428,867 | B1 | 8/2002 | Scott et al. | 428/40.1 |
| 6,431,111 | B1 | 8/2002 | Zhang | 118/43 |
| 6,457,434 | B1 | 10/2002 | Lazar | 118/32 |
| 6,457,893 | B1 | 10/2002 | Hamilton | 401/207 |
| 6,493,899 | B1 | 12/2002 | Hintz et al. | 15/231 |
| 6,497,345 | B1 | 12/2002 | Wilker et al. | 222/192 |
| 6,510,877 | B1 | 1/2003 | Trajano et al. | 141/100 |
| 6,540,118 | B1 | 4/2003 | Marciano | 222/385 |
| 6,991,527 | B2 * | 1/2006 | Linzell | 451/523 |
| 2002/0083964 | A1 | 7/2002 | McKay | 134/6 |
| 2002/0104180 | A1 | 8/2002 | Huang | 12/209.1 |
| 2002/0113149 | A1 | 8/2002 | Moosbrugger | 239/562 |
| 2003/0024062 | A1 | 2/2003 | McKay | 15/215 |
| 2003/0037390 | A1 | 2/2003 | Lablanc | 15/121 |

FOREIGN PATENT DOCUMENTS

| | | | |
|---|---|---|---|
| DE | 20001243 | | 11/2000 |
| EP | 0856277 | A1 | 8/1998 |
| EP | 0950705 | A1 | 10/1999 |
| EP | 1175999 | A1 | 1/2002 |
| GB | 2233882 | A | 1/1991 |
| JP | 11-78383 | | 3/1999 |
| JP | 11/313793 | | 11/1999 |
| JP | 2001-120466 | A | 5/2001 |
| JP | 2001-120467 | A | 5/2001 |
| JP | 2001-137168 | A | 5/2001 |
| JP | 2001-149276 | A | 6/2001 |
| JP | 2001/149292 | A | 6/2001 |
| WO | WO88/04150 | | 6/1988 |
| WO | WO90/07297 | | 7/1990 |
| WO | WO92/14395 | | 9/1992 |
| WO | WO93/22961 | | 11/1993 |
| WO | WO98/04177 | | 2/1998 |
| WO | WO99/00049 | | 1/1999 |
| WO | WO99/63879 | | 12/1999 |
| WO | WO00/70009 | | 11/2000 |
| WO | WO02/43546 | A1 | 6/2002 |
| WO | WO02/054927 | A2 | 7/2002 |

* cited by examiner

DISPENSER ASSEMBLY FOR DISPENSING LIQUID ONTO A REMOVABLE SHEET CONTAINED BY AN IMPLEMENT

This application claims the benefit of U.S. Provisional Application No. 60/483,104, which was filed on Jun. 30, 2003.

FIELD OF THE INVENTION

The present invention relates to the field of dispenser assemblies, dispensers, and refill implements usable therewith. In particular, the present invention relates to a dispenser assembly including a dispenser for dispensing a liquid product onto an implement so that a user can wipe a surface using the implement.

BACKGROUND OF THE INVENTION

Virtually every room of a home faces a barrage of small messes. The bathroom, for example, typically includes a mirror that is frequently splattered as one brushes one's teeth. Such mirrors can also become exposed to condensation after a hot shower—leaving a streaked or spotted appearance on the mirror after the condensation dries.

Up to this point, these small messes have been cleaned up with paper towels, often in conjunction with a spray cleaner, sponges, or even a mop and bucket. However, a disadvantage of cleaning in this manner is that the required tools are not always conveniently available. For example, many people do not keep paper towels and window cleaner in the bathroom, making cleaning the mirror or other hard surface, for example, with a spray cleaner and paper towels inconvenient, especially given the frequency that toothpaste may be sprayed on the mirror. One reason paper towels are not kept in the bathroom is the size and unsightliness of paper towels. Similarly, sponges are not generally kept in view, owing to their unsanitary and generally poor appearance. In addition, many rooms, especially bathrooms, do not have storage space to keep paper towels and a spray cleaner, or even a sponge, out of view.

Another disadvantage to cleaning with a spray cleaner and paper towels is that the cleaner may land on unintended targets. When cleaning a bathroom mirror over a sink, for example, some of the cleaner may miss the mirror and land on a toothbrush, for example. A similar problem occurs in other rooms of the house, such as a bedroom having a wooden dresser, in which a user intending to clean a mirror behind the dresser may accidentally spray some of the cleaner onto the wooden dresser. A related problem with spray cleaners is that the sprayed area must be wiped, but the spray often covers more than just the dirty area. As a result, clean areas are frequently sprayed and wiped, which is unnecessary effort.

There is, therefore, a need in the art for a cleaning dispenser that is compact and attractive so that it can be stored in plain view, such as on a bathroom sink, kitchen counter or dresser. In addition, there is a need for a cleaning dispenser that avoids the need to directly spray a surface that is to be cleaned, in order to minimize spraying non-targeted areas.

SUMMARY OF THE INVENTION

The present invention remedies the foregoing deficiencies in the prior art and provides an improved dispenser assembly, dispenser, and refill implement for use therewith. The dispenser assembly is used to dispense a liquid product onto the implement for subsequent application by a user. As used herein, the term "liquid product" is used broadly to encompass not only liquids, but also any flowable substance that can be dispensed through a conduit and an aperture onto a sheet of fibrous material or pre-loaded onto or impregnated into a fibrous sheet. As used herein, the terms "pre-loaded" and "pre-treated" should be construed broadly to encompass any method of applying a liquid product to a fibrous sheet, including absorption, adsorption, impregnation, coating, dipping, etc.

According to one aspect, the present invention relates to a dispenser assembly comprising a cradle and an implement disposed in the cradle. The cradle includes at least one dispensing aperture for dispensing a liquid product and a reservoir for holding the liquid product, the reservoir being in fluid communication with the at least one dispensing aperture. The implement comprises a handle having a plurality of sheets attached thereto, such that the plurality of sheets faces the cradle. At least one of the plurality of sheets is releasably attached to the handle.

According to another aspect, the present invention relates to a refill implement. The refill implement comprises a substantially rigid handle having a plurality of sheets releasably attached thereto. Each sheet of the plurality of sheets comprises a pair of liquid-penetrable mats and a liquid-impenetrable layer interposed between the pair of liquid-penetrable mats. Preferably, the refill implement also comprises a cover disposed on the handle and covering at least a portion of the handle and a portion of an outermost one of the plurality of sheets.

According to yet another aspect, the present invention relates to a dispenser comprising a cradle and a reservoir. The cradle comprises a receiving portion pivotally connected to a base, thus defining a cavity between the receiving portion and the base. The receiving portion includes at least one dispensing aperture for dispensing a liquid product. The reservoir is disposed in the cavity for holding the liquid product and is in fluid communication with the at least one dispensing aperture. When the receiving portion is pivoted toward the base, the reservoir is compressed between the receiving portion and the base, thereby expelling the liquid product from the aperture.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

Throughout the figures, like or corresponding reference numerals denote like or corresponding parts.

DETAILED DESCRIPTION OF THE PREFERRED EMBODIMENTS

The present invention relates to a compact dispenser assembly including a dispenser for dispensing a liquid product onto an implement so that a user can wipe a surface using the implement. In this manner the user's hand does not need to come in contact with the liquid product that is to be dispensed. Further, this arrangement eliminates the need to spray a surface to be cleaned, thereby avoiding over-spray from landing on the surrounding area.

The dispenser generally comprises a cradle for receiving and locating the implement, and a reservoir for storing a liquid product to be dispensed onto the implement. The implement generally comprises a handle having a plurality (or stack) of sheets attached thereto. At least one of the sheets in the stack is removable from the implement. To apply the liquid product to the implement, a user simply places the implement on the dispenser and actuates the dispenser to dispense the liquid product onto the outermost sheet of the implement. The user then removes the implement from the cradle and uses it to wipe a surface. When the outermost sheet becomes soiled, or is otherwise used up, the user can simply remove the outermost sheet to expose the next, clean sheet in the stack.

The present invention may be advantageously used to dispense any of a variety of different substances onto an implement for subsequent application by a user. For example, the present invention could advantageously be used to dispense cleaner, makeup, lotion, polishing compound, wax, paint, or any number of personal, household, or other products. Depending on the type of liquid product used, the present invention may be used to apply the liquid product to a variety of different surfaces, including glass, metal, ceramic, wood, plastic, and composites thereof. One application, to which the present invention is especially well suited, is the application of a commercially available cleaner, in particular, a glass cleaner (such as that marketed under the trademark Windex® by S.C. Johnson & Son, Inc. of Racine Wis.), to a cleaning implement in order to clean glass surfaces. Other examples of cleaners that could be used with the present invention include all-purpose cleaners (such as that marketed under the trademark Fantastic® by S.C. Johnson & Son, Inc. of Racine Wis.), furniture cleaner and/or polish (such as that marketed under the trademark Pledge® by S.C. Johnson & Son, Inc. of Racine Wis.), bathroom cleaner (such as that marketed under the trademark Scrubbing Bubbles® by S.C. Johnson & Son, Inc. of Racine Wis.), or the like. Several preferred embodiments of the present invention are described below in the context of a glass cleaner.

Figure 1:
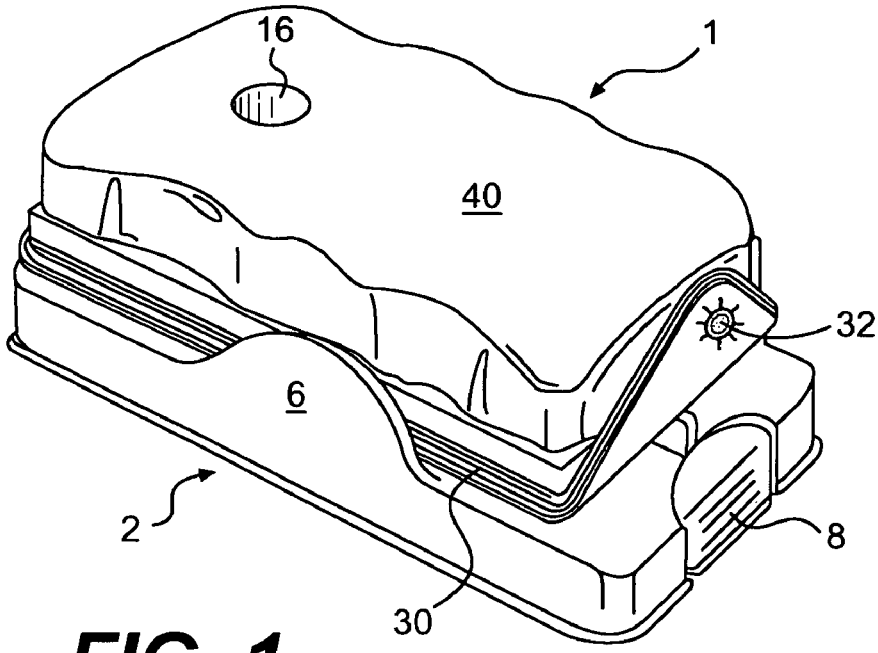
FIG. 1 is a perspective view of a dispenser assembly according to a first embodiment of the present invention.

FIG. 1 shows a perspective view of a dispenser assembly according to a first embodiment of the present invention. The dispenser assembly generally comprises a cradle 2 and an implement 1 positioned thereon. The implement includes a handle 40, in the form of a block, and a plurality (or stack) of sheets 30 attached to the bottom of the handle 40, the bottom of the handle 40 being the side facing the cradle 2.

Figure 2:
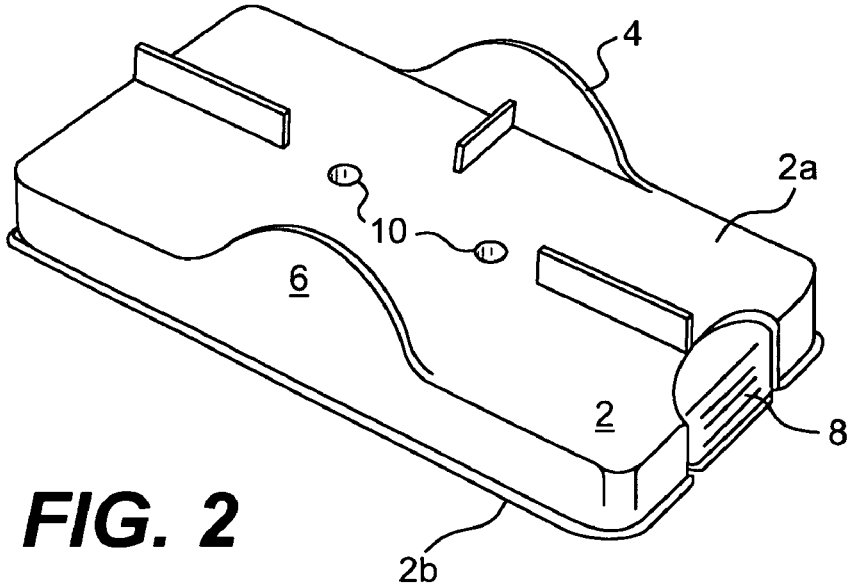
FIG. 2 is a perspective view of a cradle of the dispenser assembly of the first embodiment.
Figure 10:
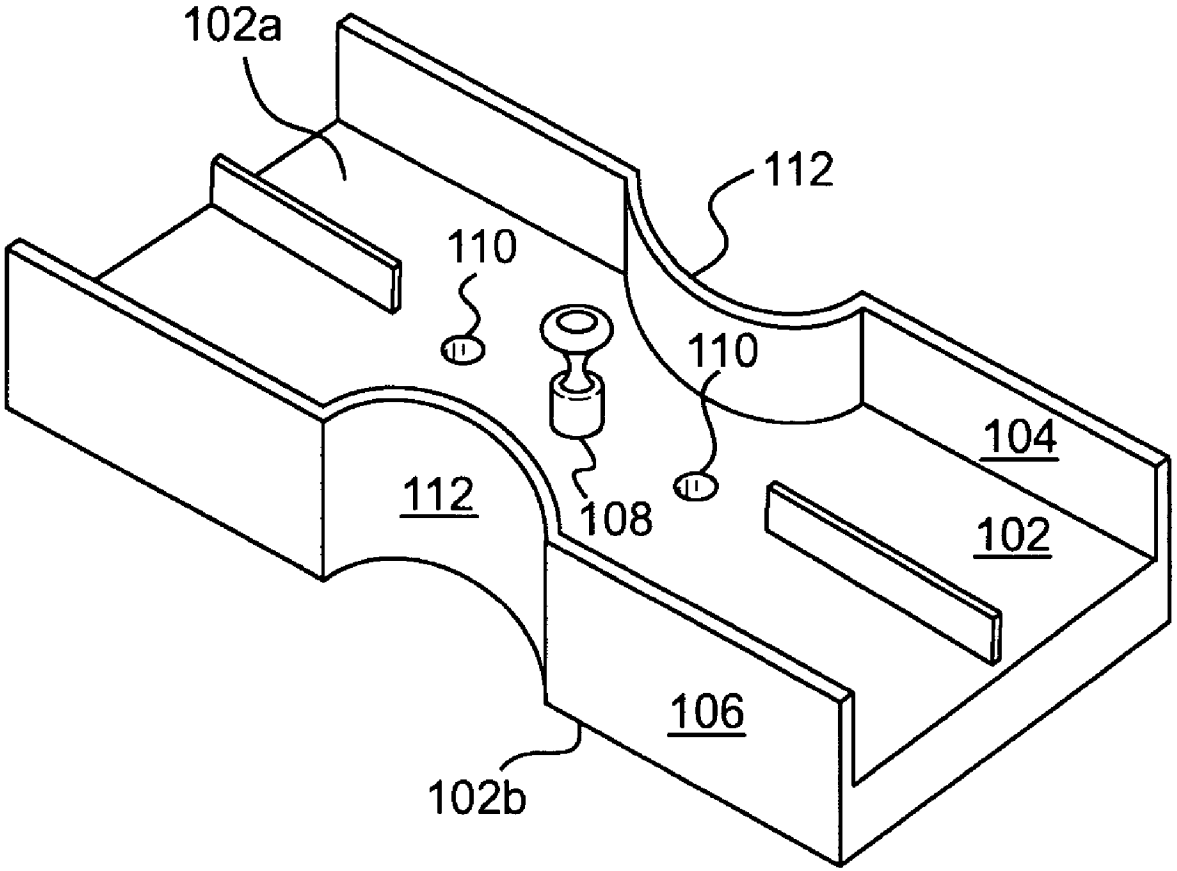
FIG. 10 is a perspective view of a dispenser according to a second embodiment of the present invention.

As shown in FIG. 2, the cradle 2 has a receiving portion 2*a* and a base 2*b*, generally defined by the top and bottom surfaces of the cradle 2, respectively. The receiving portion has a pair of dispensing apertures 10 for dispensing a liquid product therethrough. A pair of substantially upright sidewalls 4 and 6 extends from the surface of the receiving portion 2*a* and serves to locate the implement 1. Preferably, the handle 40 of the implement 1 is narrower than the spacing of the sidewalls 4 and 6, so that the handle 40 fits loosely in the space between the sidewalls and is not restrained against movement away from the cradle 2. Alternatively, in some cases, it may be beneficial for the handle 40 to be the same size or slightly wider than the spacing of the sidewalls 4 and 6, so that the handle 40 fits snugly between the sidewalls 4 and 6 and is releasably secured to the cradle 2 by an interference fit between the sidewalls 4 and 6. Although the sidewalls 4 and 6 are shown in FIGS. 1 and 2 as straight, upright panels, they may be curved to impart visual interest to the dispenser or contoured to provide a more ergonomic grip. The sidewalls 4 and 6 may also be canted slightly inwardly or outwardly. In addition, the sidewalls 4 and 6 may run the entire length of the cradle 2, similar to those of the second embodiment, shown in FIG. 10, and discussed in more detail below.

Figure 3:
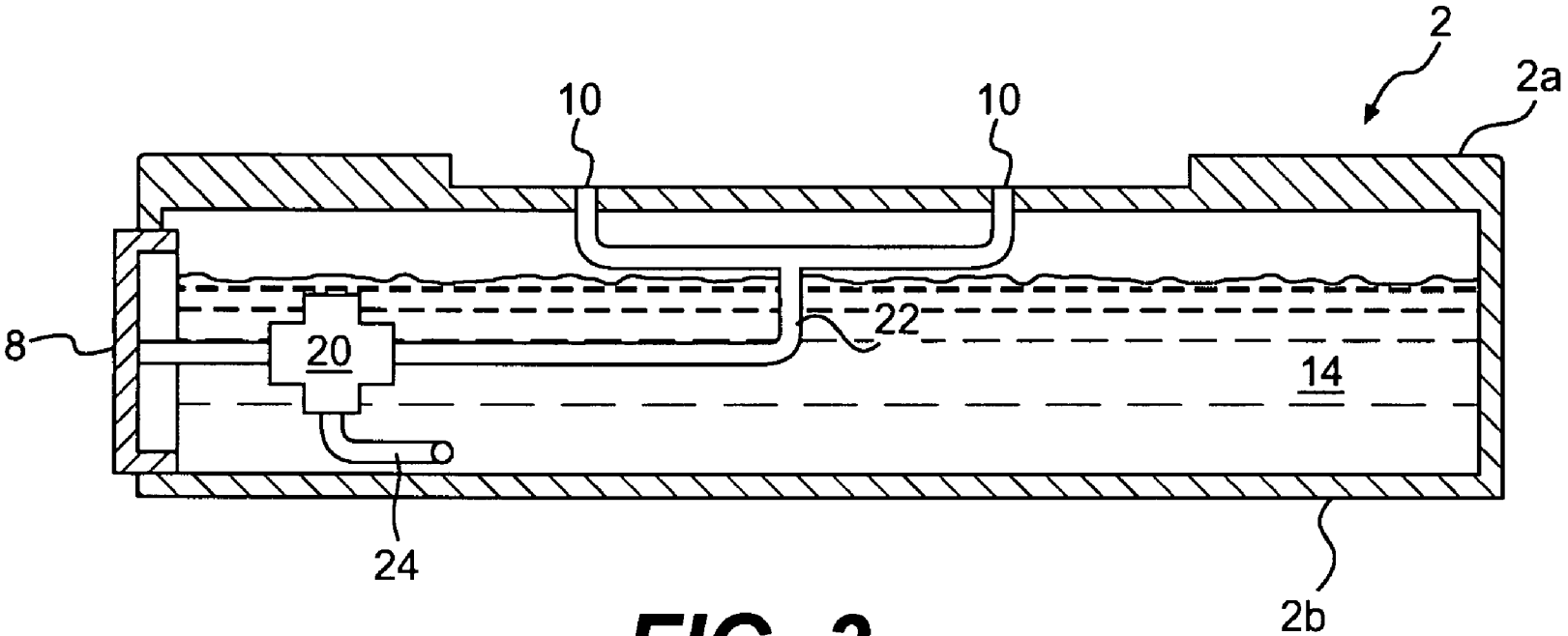
FIG. 3 is a cross-sectional view of the cradle of the first embodiment.

In this first embodiment, as best seen in FIG. 3, the cradle 2 is hollow and defines a reservoir 14 within its interior. Preferably, the reservoir 14 contains one of an all-purpose cleaner, furniture cleaner, bathroom cleaner, and glass cleaner, and may be refillable with any one of these cleaning liquids. More preferably, the reservoir 14 contains a commercially available glass cleaner. The reservoir 14, of course, could contain liquids other than those mentioned. Moreover, multiple different liquid formulations may be used in combination with one another.

Inside the reservoir 14 is a pump 20, which is connected to the dispensing apertures 10 in the receiving surface 2*a* of the cradle 2 by sections of conduit 22. A liquid pickup tube 24 extends from the pump 20 toward the lowest point in the reservoir 14. A pump actuator 8 is connected to the pump 20, such that when a user depresses the pump actuator 8, the cleaning liquid is pumped from the reservoir 14, through the conduit 22, and out of the apertures 10. In this way, when the handle 40 is placed in the cradle 2 so that the stack of sheets 30 faces the cradle 2, as shown in FIG. 1, the cleaning liquid can be pumped from the reservoir 14 onto at least the outermost sheet in the stack 30.

In one variation of the first embodiment, the cradle 2 need not contain cleaning fluid. In this case, the cradle 2 may be either hollow or solid, and the pump actuator 8, pump 20, conduit 22, and pickup tube 24 may optionally be omitted. In this variation, the plurality of sheets 30 themselves may be pre-treated by being impregnated with cleaning fluid, as will be discussed in more detail below with reference to FIG. 7.

The cradle 2 is preferably made of a substantially liquid-impenetrable, substantially rigid material, preferably polyethylene or polypropylene; however, other materials may be used, such as styrene, acrylonitrile butadiene styrene (ABS), or the like. In addition, the cradle 2 is preferably injection molded, but other manufacturing techniques may also be used. Although the cradle 2 is shown having a generally rectangular peripheral shape, the cradle 2 may instead take a variety of different peripheral shapes, including triangular, circular, S-shape, C-shape, or any other shape, as aesthetic and functional choices dictate. The only constraint is that the cradle 2 should be able, in some way, to support and/or to position the cleaning implement 1. Preferably, the cradle 2 is similar in shape to the implement 1.

Figure 4:
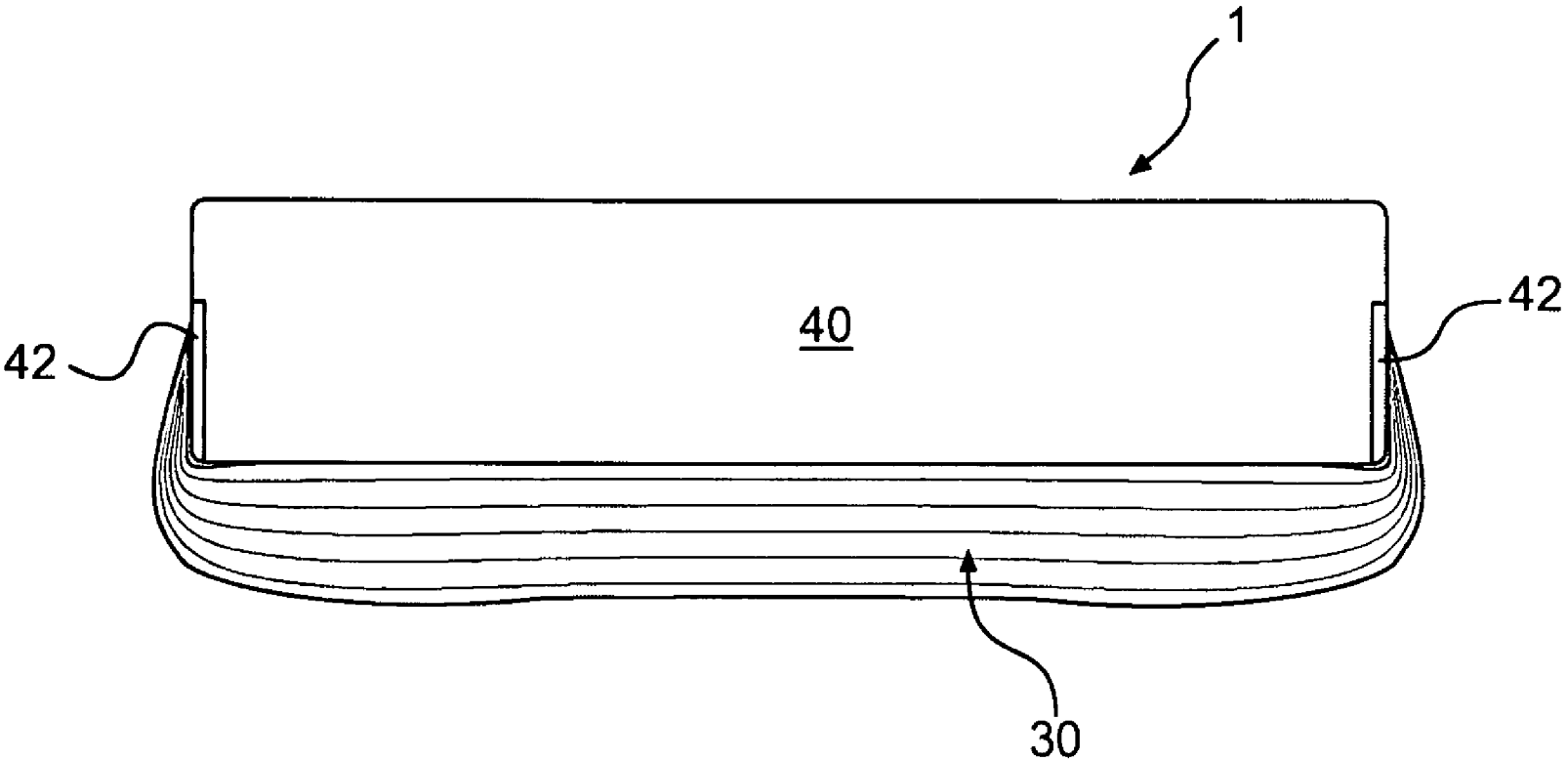
FIG. 4 is a side view of an implement of the first embodiment.

FIG. 4 is a side view, illustrating the handle 40 and the attached stack of sheets 30. The handle 40 is preferably substantially rigid, so as to maintain the stack of sheets 30 in a substantially taught, planar condition during use. In this embodiment, the handle 40 is made of molded polyurethane foam; however, any material that is substantially rigid, i.e., that supplies a sufficient amount of structural integrity to tension the stack of sheets 30 and hold them substantially flat during use, may effectively be used. A pair of hard plastic inserts 42 may be included—one at each end of the handle 40—to provide secure anchors for the stack of sheets 30.

The handle 40 of the first embodiment is shown as having a substantially rectangular cross section and being sized to fit in a user's hand (preferably, the average adult's hand). In practice, however, the shape and size of the handle may depend on a multitude of design considerations, including the size and accessibility of an area to be treated by the implement, the age of the intended user, the location and orientation of a surface to be treated (e.g., table top, floor, mirror, etc.), and a multitude of other design considerations. For example, it may be desirable for the handle to have a low profile and/or narrow width, so that it can be used to clean hard to reach places, such as under the refrigerator door, behind handles, or the like. In addition, or instead, the handle could be provided with an extension unit, so that the implement can be used to clean remote surfaces, such as the ceiling, cabinets, the floor, or the like.

The handle may also include a receptacle for holding various objects. For example, in FIG. 1, a receptacle 16 is depicted as being a cylindrical cavity formed in the handle 40 to hold a toothbrush. Of course, any other size or shape of receptacle 16 may be used, depending on the object that is to be held therein.

Figure 5:
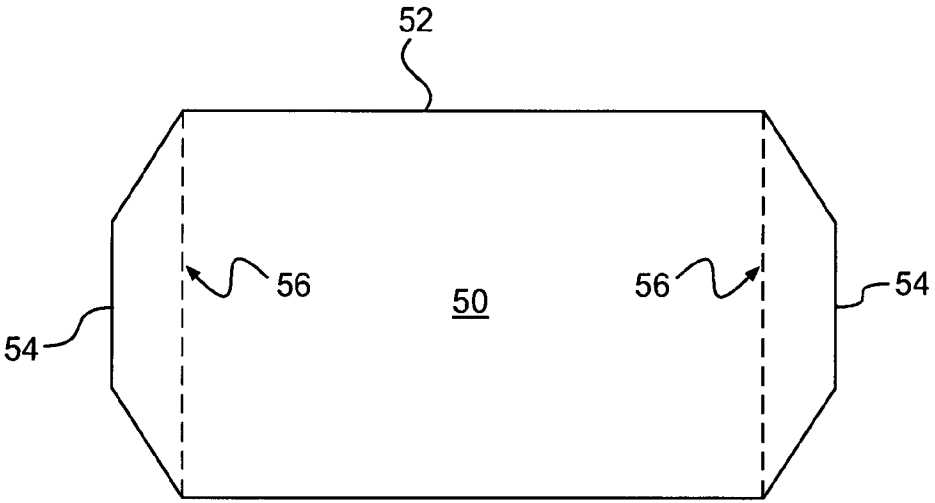
FIG. 5 is a plan view of one sheet of the implement of the first embodiment.

As shown in FIG. 5, each sheet 50 of the stack 30 has a generally rectangular main body 52 and a pair of trapezoidal tabs 54—one at each end—with a perforation forming the boundary between the main body 52 and the trapezoidal tabs 54. Of course, the sheet 50 can be any suitable shape and need not be substantially rectangular. The sheet 50 is preferably similar or complimentary in shape to the handle 40 and/or the cradle 2. Therefore, if the handle 40 or cradle 2 is generally rectangular, as shown in FIG. 1, each sheet 50 is also preferably generally rectangular. In addition, the size and shape of the tabs 54 may be varied as needed to effectively attach the sheets 50 to the handle 40. Alternatively, the tabs 54 may be omitted entirely such that each sheet 50 consists of only a main body 52.

When all of the sheets 50 in the stack 30 are the same size and the stack contains a relatively large number of sheets, some puckering or bunching of the inner sheets may occur. Thus, the stack of sheets 30 may comprise sheets of at least two different lengths/sizes, with the inner sheets being shorter/smaller than the outer sheets. For example, with respect to the implement shown in FIG. 4, the inner half of sheets might be of a first length, while the outer half of sheets are of a length longer than the first length. Any number of different length sheets could be used, with the shortest sheet(s) being the innermost sheet(s), followed by the next shortest sheet(s), and so on, with the longest sheet(s) being the outermost sheet(s). Similarly, if the implement is made in some other shape, such as, for example, triangular, the innermost sheet(s) should be similar in shape to, but smaller than, the outermost sheet(s).

The perforations 56 comprise a plurality of slits formed in a line, each slit being spaced about 1/32" (0.794 mm) away from an adjacent slit—although this distance may be increased or decreased as manufacturing realities and ease of use require. The perforations 56 are preferably formed using two offset dies, in which a first die punches half of the slits of each perforation 56 and a second die punches the remainder of the slits. Other conventional perforation methods may, of course, also be used, such as a single die and anvil arrangement. The perforations 56 are formed in such a way as to allow a user to easily separate the main body 52 from the trapezoidal tabs 54, but to prevent the sheets from becoming detached unintentionally.

Preferably, as shown in FIG. 1, all of the sheets are affixed at each end of the handle 40 via mechanical means 32, such as a staple, rivet or other anchor. The mechanical means 32 may be attached directly to the handle 40 (as shown in FIG. 1), or it may be attached to an insert 42 (as shown in FIG. 4) to provide a stronger anchor point for attachment of the stack of sheets 30. The sheets 50 might be attached to the top or bottom of the handle 40 in addition to, or instead of, the ends. In addition, some of the sheets 50 may be affixed via mechanical means 32, adhesive, or a combination of both. For example, one of the sheets 50, namely a top (or innermost) sheet, may be secured by the tabs 54 to the handle 40 or insert 42 by way of mechanical means 32. Each of the remaining sheets of the stack 30 (i.e., the sheets not including the innermost sheet) may be adhered, for example with pressure-sensitive adhesive, to the tab 54 of the next adjacent sheet 50 to form the stack 30, as shown in FIG. 4.

If a pressure-sensitive acrylic adhesive is used to adhere each sheet 50 to the stack 30 or handle 40, the adhesive is preferably applied only on the tabs 54 of each sheet 50. Of course, the adhesive may be applied around the entire periphery of each sheet 50. Preferably, no adhesive is applied in the middle of each sheet 50, which comes in contact with a surface that is to be cleaned.

Figure 9:
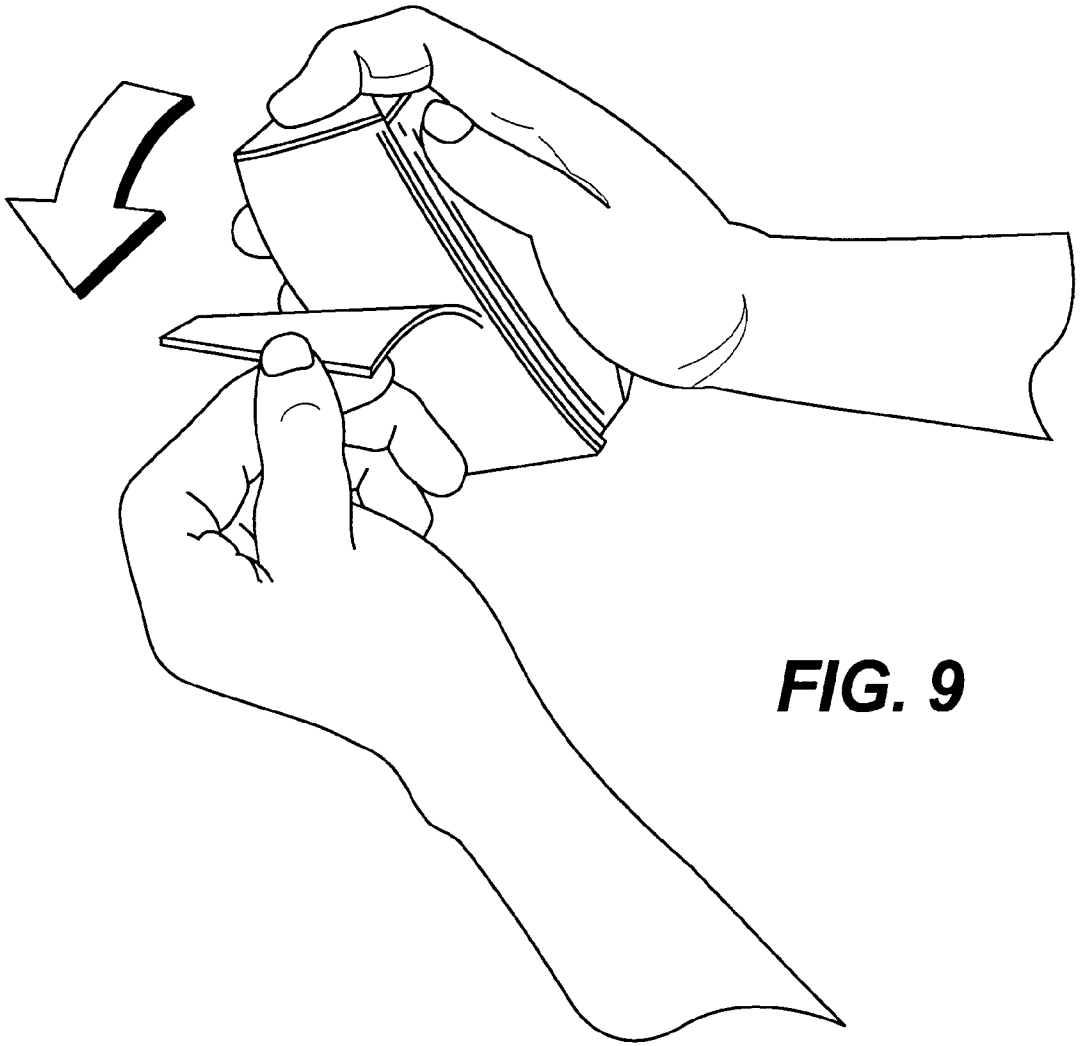
FIG. 9 shows a sheet being removed from the stack of sheets of an implement of the present invention.

As shown in FIG. 9, the sheets can be removed from the stack 30 by peeling each sheet (if the sheet is adhered) or tearing each sheet along the perforation 56 (if the sheet is affixed via mechanical means 32). Of course, even if the sheet is adhered, it may be possible to tear the sheet along the perforation 56 in order to remove it.

Figure 6B:
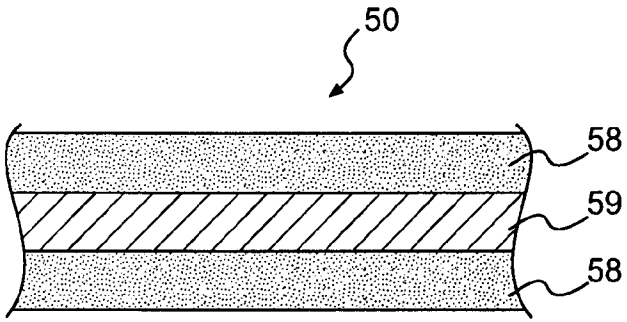
FIGS. 6A and 6B are cross-sectional views of a sheet of the first embodiment.
Figure 6A:
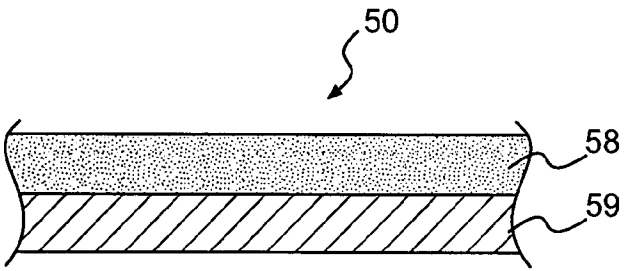

As shown in FIG. 6A, each sheet 50 of the stack of sheets preferably comprises a liquid-penetrable mat 58 and a liquid-impenetrable layer 59. The mat 58 preferably comprises a nonwoven, fibrous, synthetic material, such as Sontera® 8005, manufactured by Dupont Nonwovens, Sontara Technologies, Old Hickory, Tenn., the fibers of which have an average size of at least one micron (i.e., it is a non-microfiber material). Mat 58 is preferably made of non-microfiber materials due to their scrubbing efficacy, minimal streaking, minimal lint deposits, and superior gliding ability. As used herein, the term "gliding ability" refers to the ease with which the sheet may be slid across a surface, and is primarily dependent on the coefficient of friction between the sheet and the surface. In addition, it has been found that if a hydrophobic material is used for the fibers of the mat 58, the gliding ability of the mat 58 is further improved; however, hydrophilic materials may also be used. Even more preferably, the material is a spunbond material and is manufactured by a hydroentangling process. This eliminates the need for a binder to hold the fibers of the mat 58 together and helps to prevent streaking and lint deposits.

Alternatively, the mat 58 may be constructed of a microfiber material, such as Daego Spunlace MF 80 g/m$^2$, manufactured by Daego Co., Ltd., of the Republic of Korea, or a combination of microfiber and non-microfiber materials. As used herein, a "microfiber mat" is a non-woven material composed of fibers having a diameter preferably less than about one micron, more preferably less than about 0.5 micron and most preferably less than about 0.1 micron. Microfiber materials have a much greater contact surface area than do the non-microfiber materials. The smaller contact surface area of the non-microfiber materials equates to a lower coefficient of friction between the sheet and the surface to be treated, which accounts for the superior gliding ability of the non-microfiber materials. On the other hand, microfiber materials, due to their greater contact surface area, are capable of holding a larger amount of dirt and other contaminants. Accordingly, microfiber materials may be advantageous in very dirty environments or when prolonged use of each sheet is desired.

While one currently preferred embodiment of the mat 58 is described above as being a nonwoven, fibrous, synthetic material, the mat 58 may effectively be made of synthetic fibers, natural fibers, or a combination thereof, and may be either woven or nonwoven depending on the desired characteristics of the mat 58. Other materials that may suitably be used to make mat 58 include polyester, nylon, polyethylene, cellulose, and composites thereof. However, if natural fibers, such as cellulose fibers, are used, these fibers are preferably not positioned on the surface of the mat 58 that comes into contact with the surface to be cleaned, as this would decrease the gliding ability of the sheets 50.

The liquid-impenetrable layer 59 preferably comprises a thin sheet or film of plastic. The liquid-impenetrable layer 59 may be a monolayer of film, such as Bynel® 418, manufactured by E.I. Du Pont de Nemours and Company, of Wilmington, Del., or it may be a coextrusion of two or more sheets of liquid-impenetrable plastic material, such as low density polyethylene, ethylene vinyl acetate, polyolefin, and/or various other known polymeric or plastic materials. The liquid-impenetrable layer 59 is preferably heat-sealed, but may be adhered with pressure-sensitive adhesive, to the microfiber mat 58. The liquid-impenetrable layer 59 prevents dirt and fluid from penetrating each sheet 50. The back surface (i.e., the surface furthest from the surface that is to be cleaned) of the liquid-impenetrable layer 59 is preferably provided with a high-friction surface, so that the sheets 50 in the stack of sheets 30 do not slide relative to one another during use. That is, the friction between sheets 50 in the stack 30 helps to maintain the stack stability during use.

In an alternative arrangement, as shown in FIG. 6B, each sheet 50 of the stack of sheets 30, may comprise a pair of liquid-permeable mats 58 with a liquid-impenetrable layer 59 interposed therebetween. In this arrangement, each of the mats 58 and the liquid-impenetrable layer 59 may be constructed of any of the materials, and by any of the methods, discussed above. Preferably, however, in this arrangement, the mat 58 that is furthest from the surface that is to be cleaned is made of a synthetic, nonwoven microfiber material, such as Dupont Sontara® 8017, manufactured by Dupont Nonwovens, Sontara Technologies, Old Hickory, Tenn. By having a mat 58 on either side of the liquid-impenetrable layer 59, friction between the sheets 50 is increased and the feel and appearance of the sheets 50 are improved.

Figure 7:
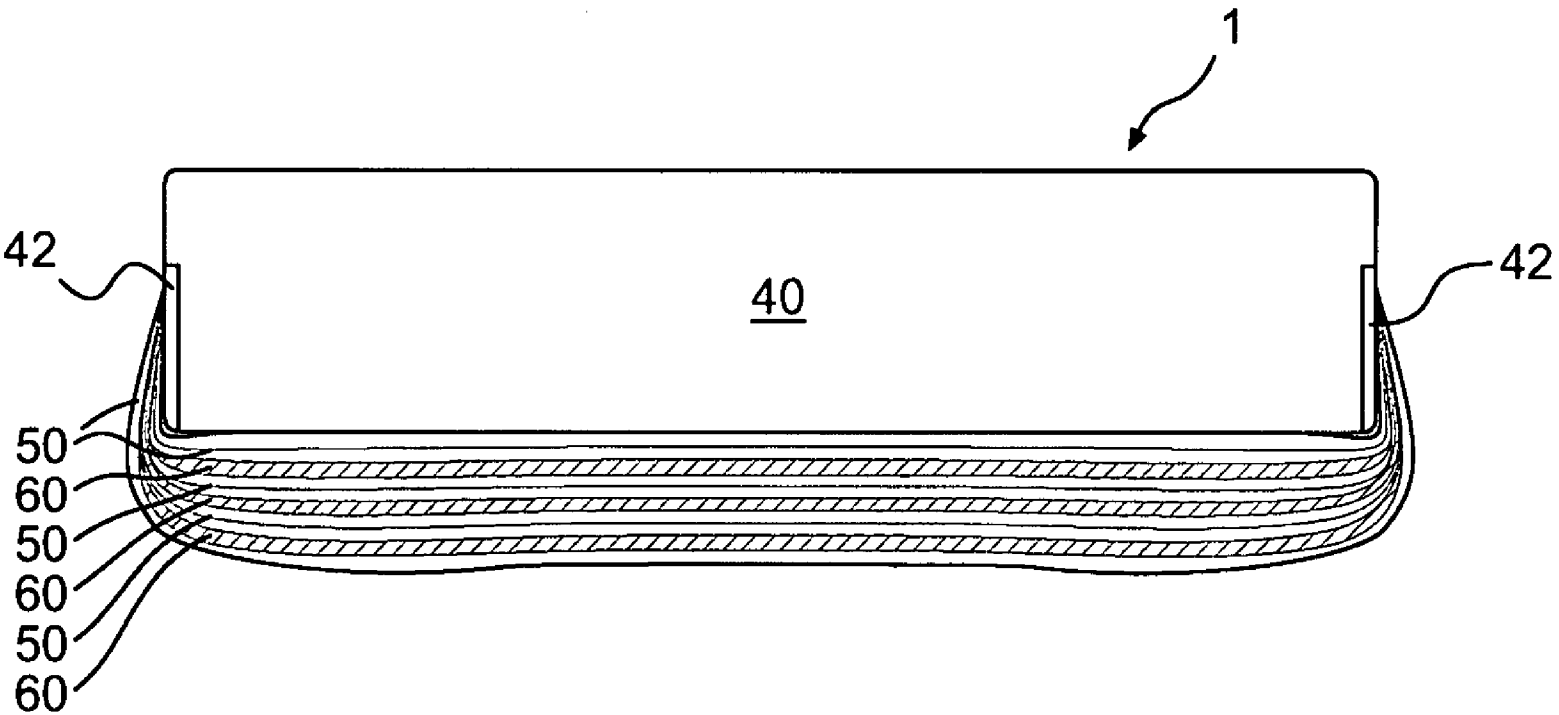
FIG. 7 is a side view of the implement of the first embodiment, illustrating a plurality of sheets, including a liquid-impenetrable sheet.

In yet another alternative construction, as shown in FIG. 7, a liquid-impenetrable sheet 60 may be interposed between each sheet 50 in the stack 30. The liquid-impenetrable sheet 60 may be made of a plastic film such as polyolefin, low density polyethylene or ethylene vinyl acetate, a thin foil, wax paper, or any other material that provides a liquid barrier.

The arrangement shown in FIG. 7 is particularly suited to using sheets that have been pre-treated with cleaning fluid. The sheet 50 shown in FIGS. 6A and 6B may also be pre-treated. With such pre-treated sheets, there is no need for the cradle 2 to include a reservoir 14 or the related hardware needed to dispense liquid cleaner onto the sheet.

A second embodiment of the invention differs from the first embodiment primarily in the placement of the pump actuator 108 on the cradle 102. In the second embodiment, shown in FIG. 10, the pump actuator 108 is placed on a top, receiving portion 102*a* of the cradle 102. In this configuration, when the handle 40 is fit into the cradle 102 so that the plurality of sheets 30 is facing the receiving portion 102*a*, a user places the base 102*b* of the cradle 102 on a surface and presses the handle 40 downward. The pressing force created by the user moves the handle 40 relative to the cradle 102 so that the stack 30 depresses the pump actuator 108. This causes the cleaning liquid within the reservoir (not shown) to be dispensed through a pair of dispensing apertures 110 onto the sheet facing the receiving portion 102*a* in the same manner as in the first embodiment.

In addition, in the second embodiment, a pair of sidewalls 104 and 106 is shown extending the entire length of the cradle 102 and including indentations 112 for the thumb and fingers of a user. The shape and configuration of the sidewalls may, as noted above, be varied depending on various design considerations.

Figure 11:
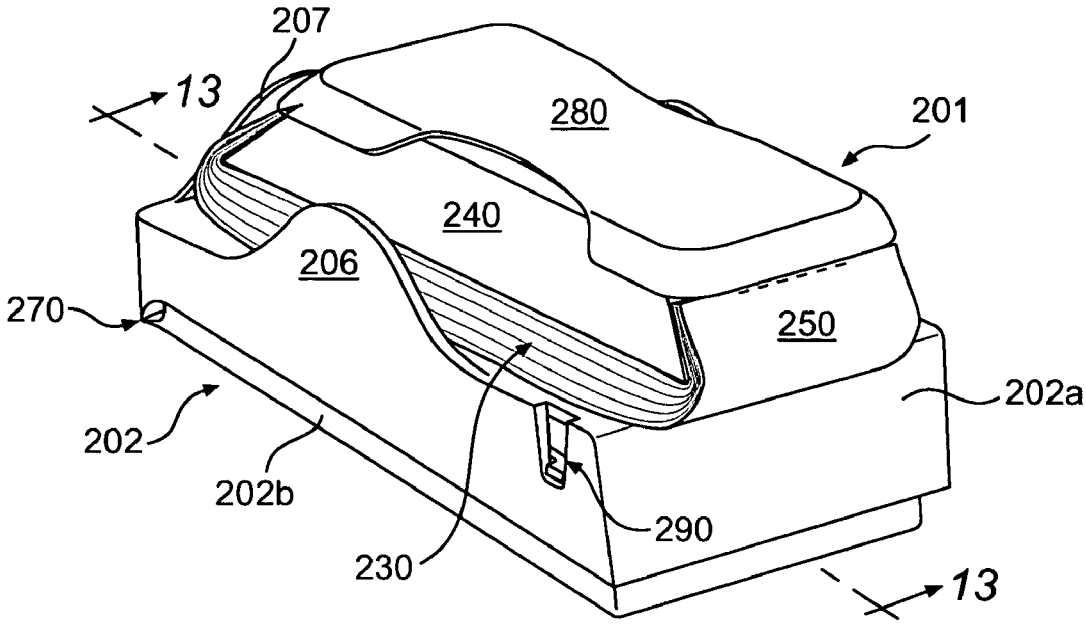
FIG. 11 is a perspective view of a dispenser assembly according to a third embodiment of the present invention.
Figure 12:
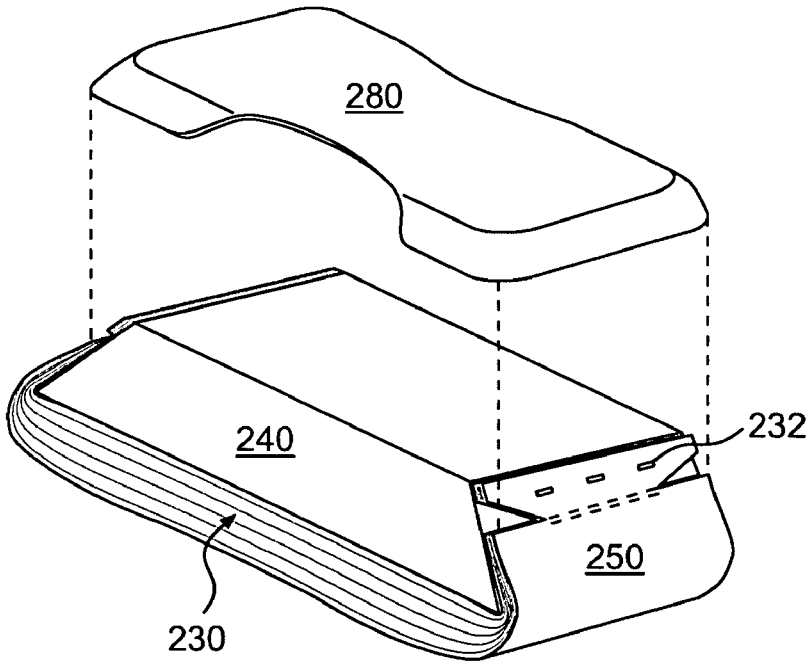
FIG. 12 is an exploded perspective view of the dispenser assembly of the third embodiment.

A third embodiment of the present invention is depicted in FIGS. 11-16. The third embodiment is similar to the first and second embodiments in many respects. As shown in FIG. 11, the dispenser assembly of the third embodiment includes a cleaning implement 201 received in a cradle 202.

Figure 13:
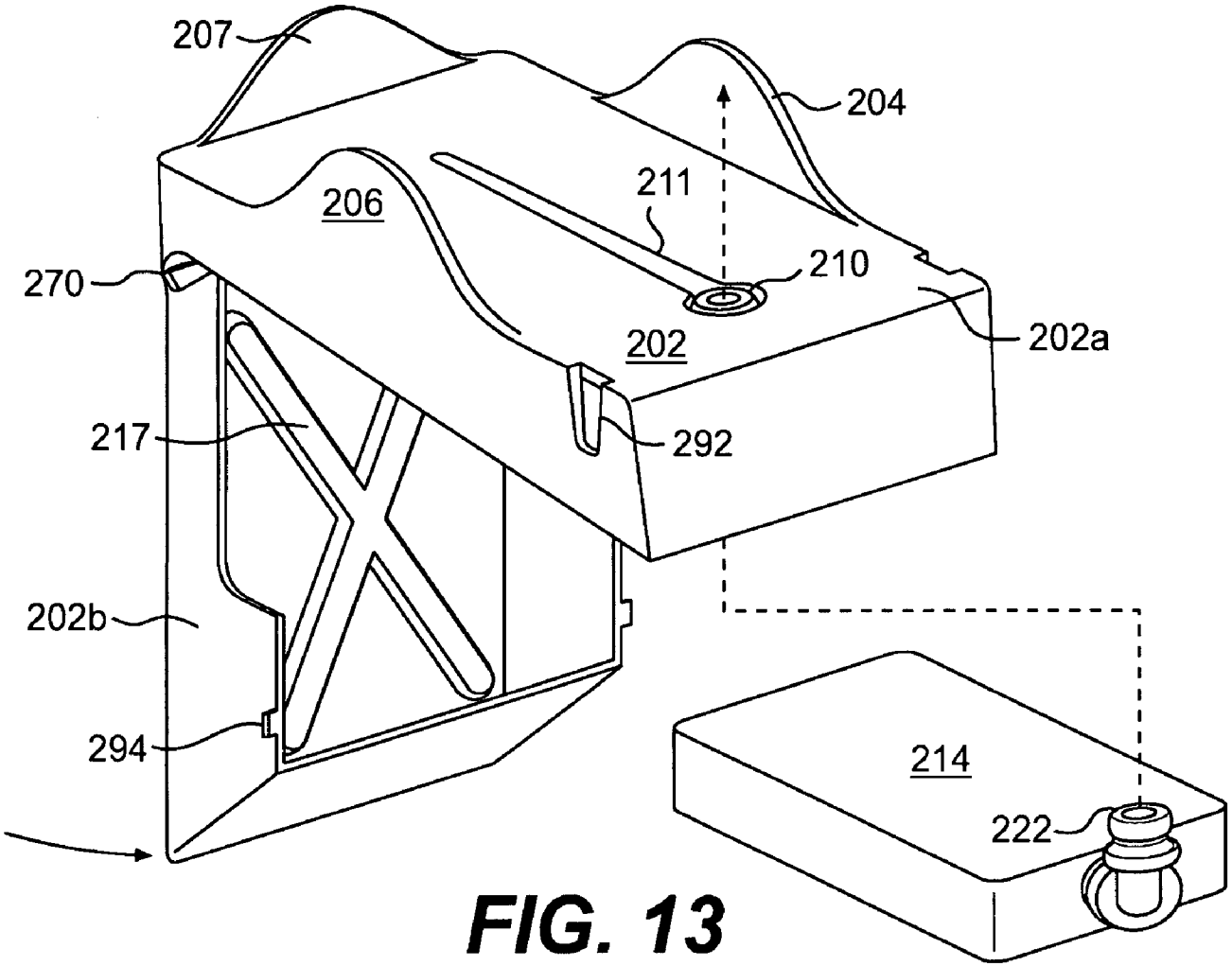
FIG. 13 is an exploded perspective view of the dispenser of the third embodiment, with the cradle in a partially unfolded position.

In this embodiment, the cradle 202 comprises a receiving portion 202*a*, which is pivotally connected to a base 202*b* by a hinge 270, such as a living hinge. That is, the receiving portion 202*a* and base 202*b* are preferably formed from a single piece of material with a region of thinner wall thickness formed at their connection. The thin region is easily bendable, such that the receiving portion 202*a* and base 202*b* are allowed to pivot relative to one another about the hinge 270, as best seen in FIG. 13. The receiving portion 202*a* and base 202*b* are each hollow on one side thereof, such that when folded, as shown in FIGS. 11 and 14, the receiving portion 202*a* and base 202*b* form a cavity therebetween.

Referring to FIG. 13, the receiving portion 202*a* has a dispensing aperture 210 formed therethrough and a tapered drain trough 211 extending along its surface. This embodiment includes a pair of sidewalls 204 and 206, similar to those of the first embodiment, and an end wall 207. Together, the sidewalls 204 and 206 and the end wall 207 define a receptacle for locating the cleaning implement. The base 202*b* includes a raised, X-shaped rib 217 that provides structural support to the base 202*b*.

Figure 14:
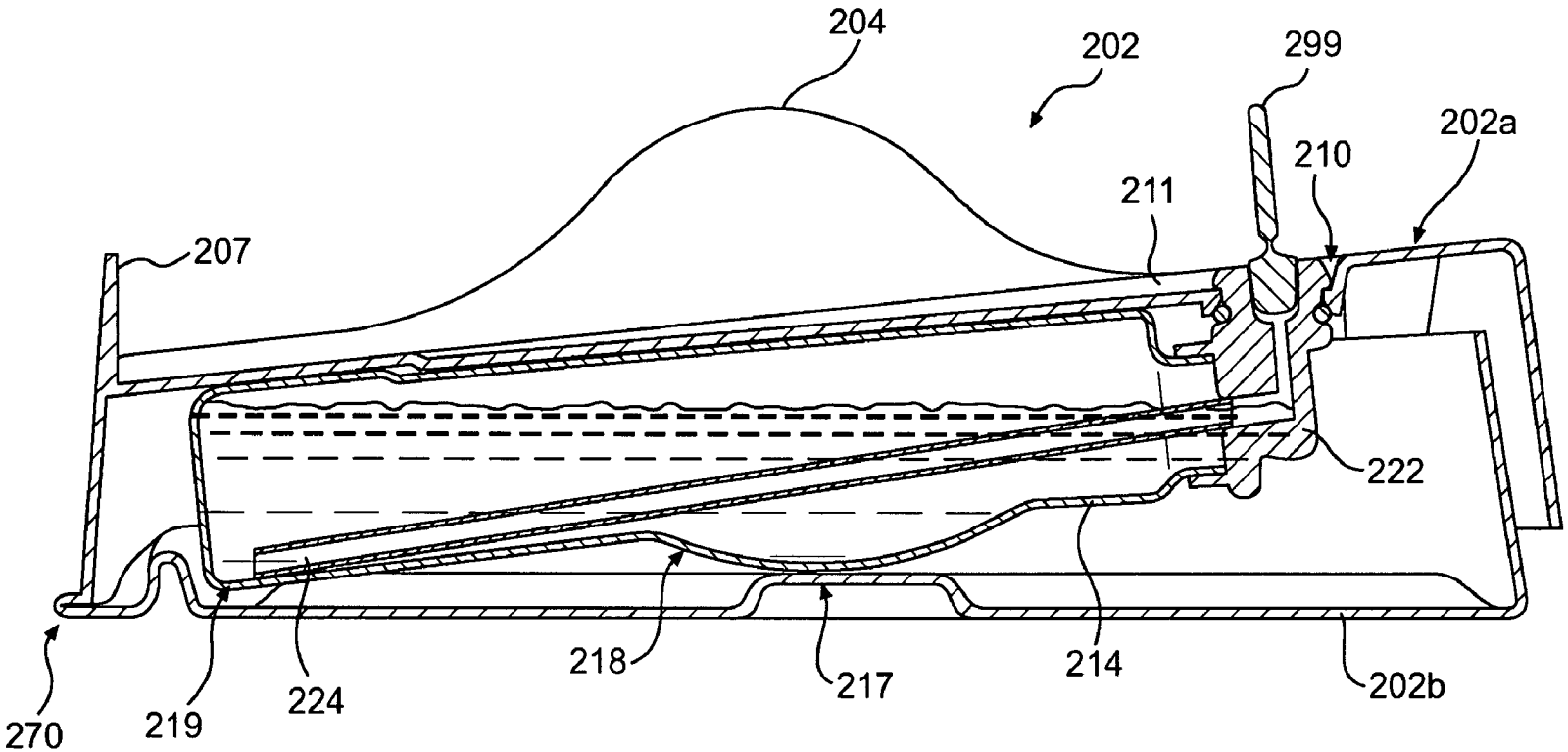
FIG. 14 is a cross-sectional side view of the dispenser of the third embodiment, showing the cradle in a folded position.
Figure 15:
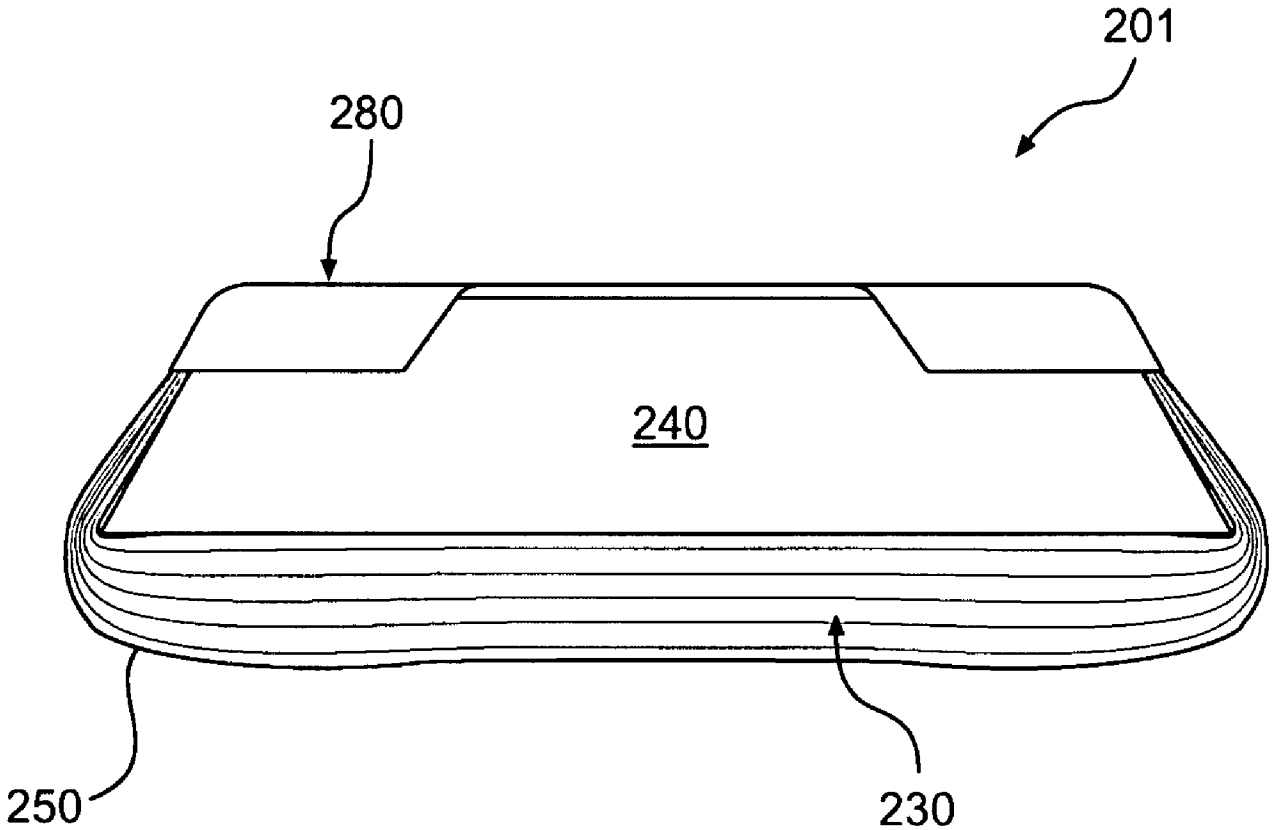
FIG. 15 is a side view of an implement of the third embodiment.

Referring now to FIGS. 13 and 14, a reservoir 214 fits in the cavity formed between the receiving portion 202*a* and base 202*b*. A piece of conduit 222 fluidly connects an opening in the reservoir 214 with the dispensing aperture 210 formed in the receiving portion 202*a*. A liquid pickup tube 224 extends from the conduit 222 to the lowest point in the reservoir 214. As shown in FIG. 14, the reservoir 214 includes a mound 218, which abuts the rib 217 of the base 202*b* when the cradle 202 is folded.

A latch mechanism 290 is provided for latching the receiving portion 202*a* and the base 202*b* in a folded position to enclose the reservoir 214 during use, as best seen in FIG. 14. The latch 290 comprises a protrusion 294 formed on the base 202*b*, which engages with a slot 292 formed in the receiving portion 202*a* to hold the cradle 202 in a folded position. When latched, the receiving portion 202*a* is still allowed to pivot relative to the base 202*b*, but the range of pivoting is limited to the length of the slot 292.

During assembly, the reservoir 214 is installed in the cavity formed between the receiving portion 202*a* and the base 202*b*, and the cradle 202 is then folded and latched in the position shown in FIG. 14. Thus, the reservoir 214 is enclosed and the ability of the receiving portion 202*a* to pivot relative to the base 202*b* is limited. A plug 299 may be inserted in the dispensing aperture to seal the liquid product in the reservoir 214 during shipping. This plug 299 must be removed prior to using the dispenser.

Figure 19:
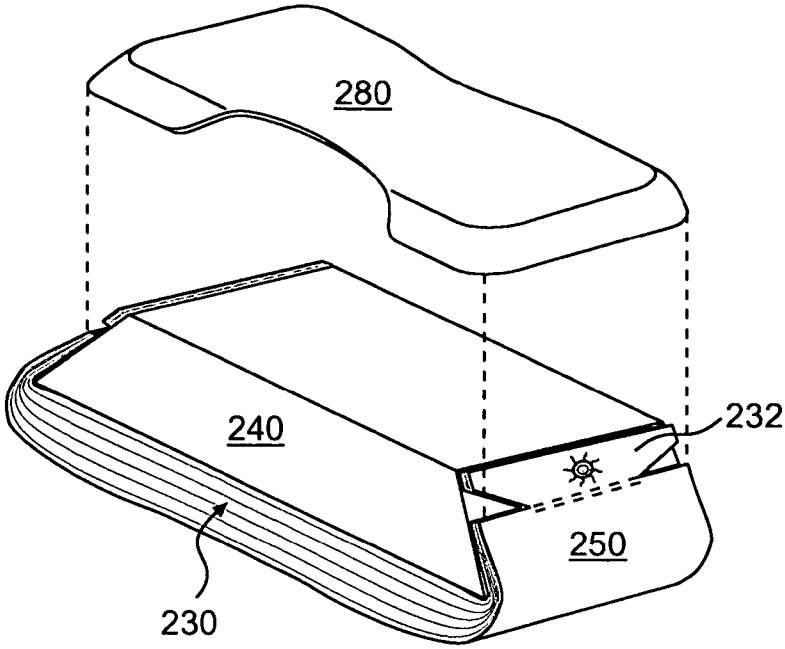
FIG. 19 is an exploded perspective view of the dispenser assembly of this embodiment.
Figure 20:
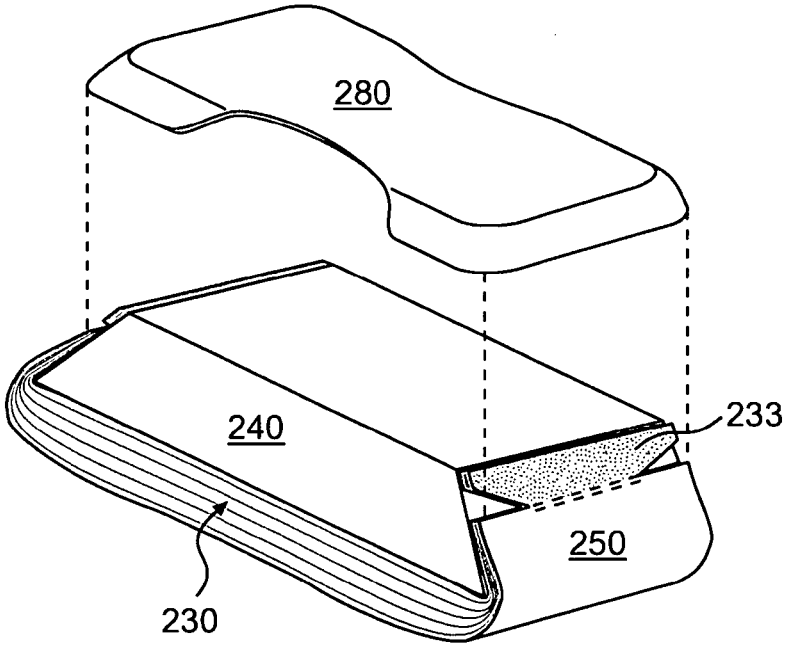
FIG. 20 is an exploded perspective view of the dispenser assembly of the third embodiment.

Referring back to FIG. 11, the cleaning implement 201 of the third embodiment is similar to that of the first embodiment in that it comprises a handle 240 in the form of a somewhat rigid polyurethane foam block with a stack of sheets 230 releasably attached thereto. In this embodiment, however, the handle 240 has a trapezoidal profile and a hard plastic cover 280 is disposed on a side of the handle 240 opposite from the stack of sheets. The cover 280 extends over the tabs 254 of the sheets 250 and covers the mechanical fastening means 232 (illustrated as three staples in FIG. 12 and as a rivet in FIG. 19 substantially similar to the rivet shown in FIG. 1), or the adhesive 233 (i.e., a pressure sensitive and/or a permanent adhesive) illustrated in FIG. 20 used to attach the sheets 250 to the handle 240. In addition to providing an aesthetic appearance, the cover 280 lends some rigidity to the handle 240. Just as in the first embodiment, the handle 240 may be narrower than the sidewalls 204 and 206 so as to fit loosely therebetween, or slightly wider than the sidewalls 204 and 206 so as to fit snugly therebetween.

Figure 16:
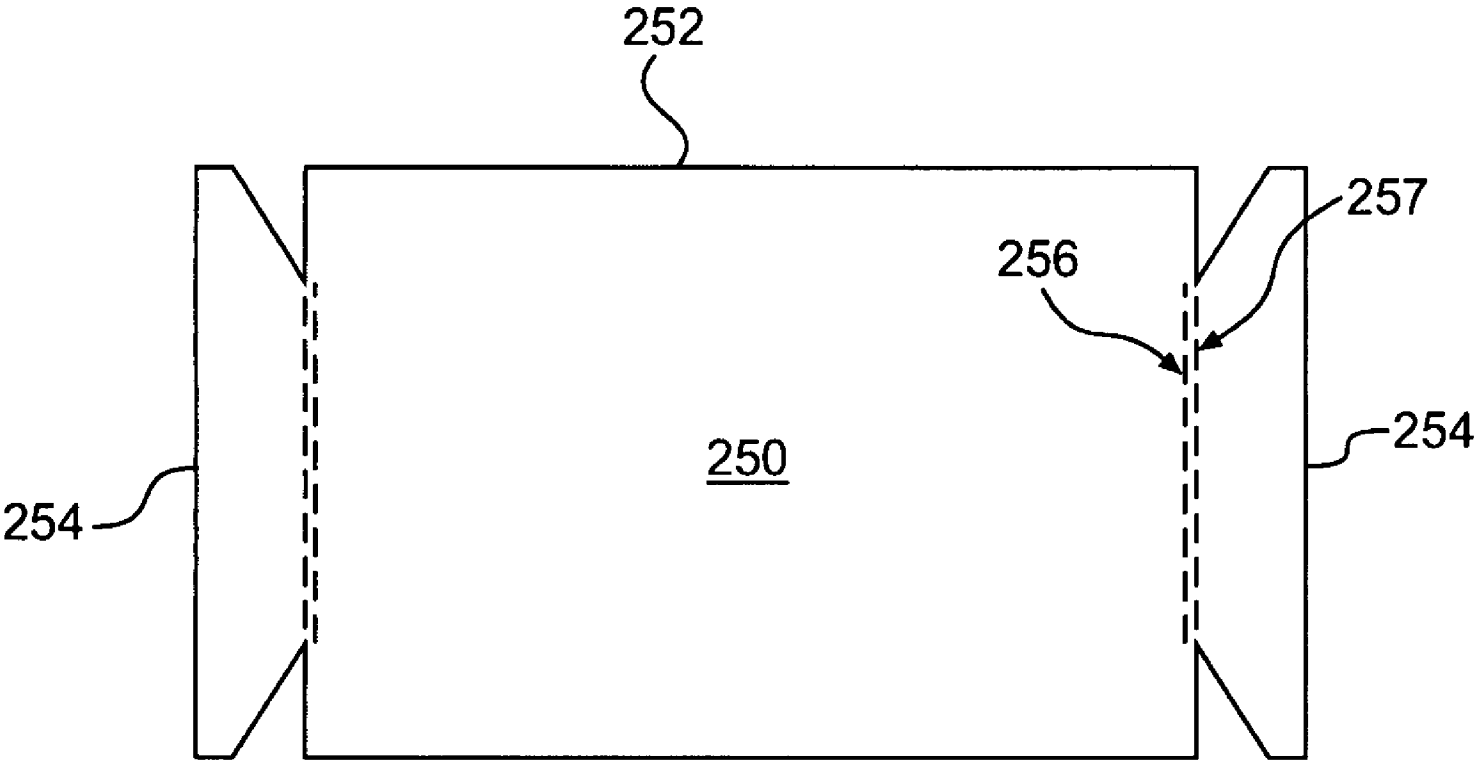
FIG. 16 is a plan view of one sheet of the implement of the third embodiment.

The stack of sheets 230 comprises a plurality of sheets 250 similar to those of the first embodiment. As shown in FIG. 16, in this embodiment, each sheet 250 again comprises a main body 252 and a pair of tabs 254—one at each end of the sheet 250. The tabs 254 in this embodiment are again trapezoidal in shape, but are arranged in an inverted position. Also, the tabs 254 in this embodiment are separated from the main body 252 by two parallel lines of perforation 256 and 257. The second line of perforation 257 is preferably offset or staggered relative to the first line of perforation 256. The lines of perforations may be formed in the same manner as discussed above with respect to the first embodiment. This arrangement facilitates easy removal of the sheets.

Figure 8:
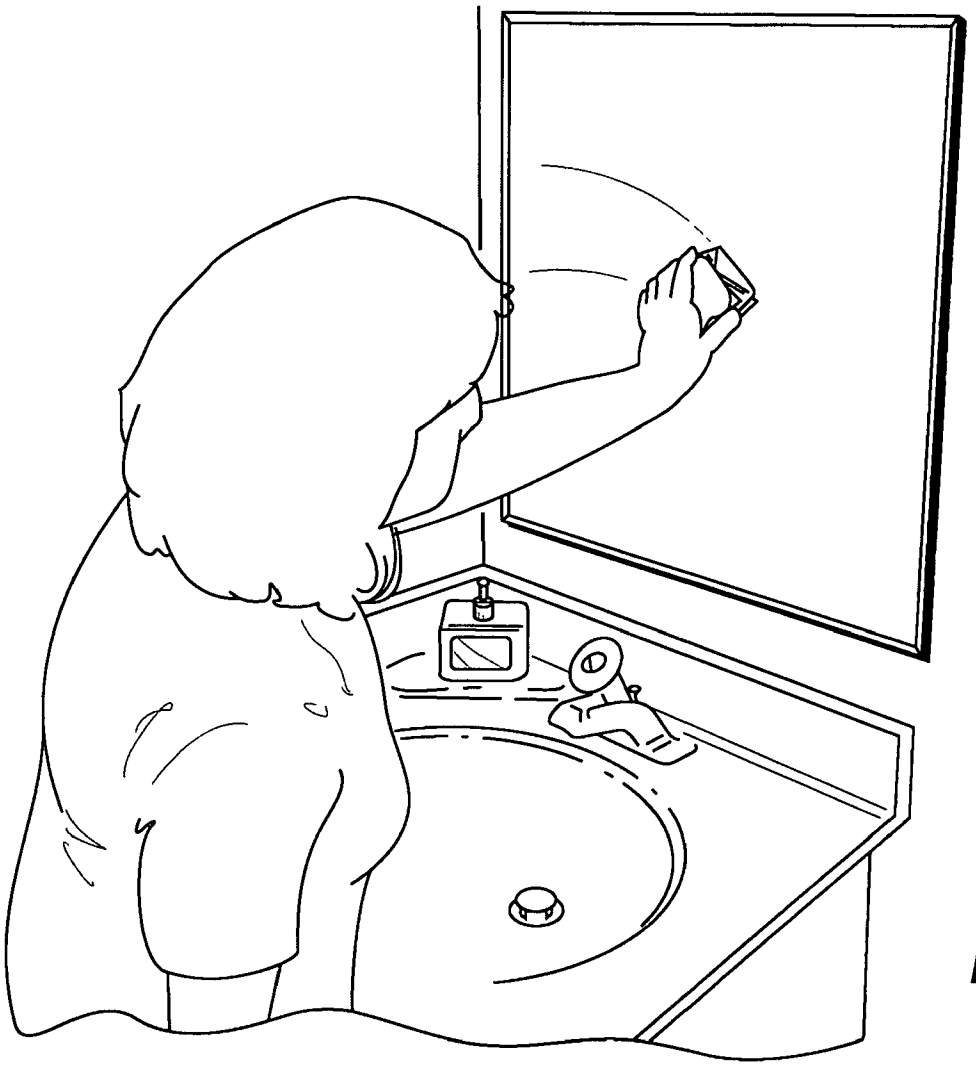
FIG. 8 shows a user wiping a surface with the dispenser assembly of the present invention.

In use, a user simply places the cleaning implement 201 on the receiving surface 202*a* of the cradle 202, as shown in FIG. 11. To dispense the cleaning liquid, the user presses the implement 201 downward, which in turn presses the receiving portion 202*a* toward the base 202*b* of the cradle 202. As the cradle 202 is compressed, the rib 217 (see FIG. 13) of the base 202*b* abuts and presses on the mound 218 of the reservoir 214. This compression of the reservoir 214 forces cleaning liquid up the pickup tube 224, through the conduit 222, out of the dispensing aperture 210, and into the sloped trough 211. Because the trough 211 is sloped downward away from the dispensing aperture 210 (toward the left in FIG. 14), the cleaning liquid is applied along substantially the entire length of the outermost sheet of the stack 230. The user then removes the handle 240 from the cradle 202 to wipe a surface, as shown in FIG. 8. When a sheet in the stack 230 is soiled, it is torn or peeled off, as shown in FIG. 9, to expose a new, fresh sheet. Of course, a sheet may be removed even if it is not soiled, if a user desires to use a sheet without the handle 240.

Figure 17:
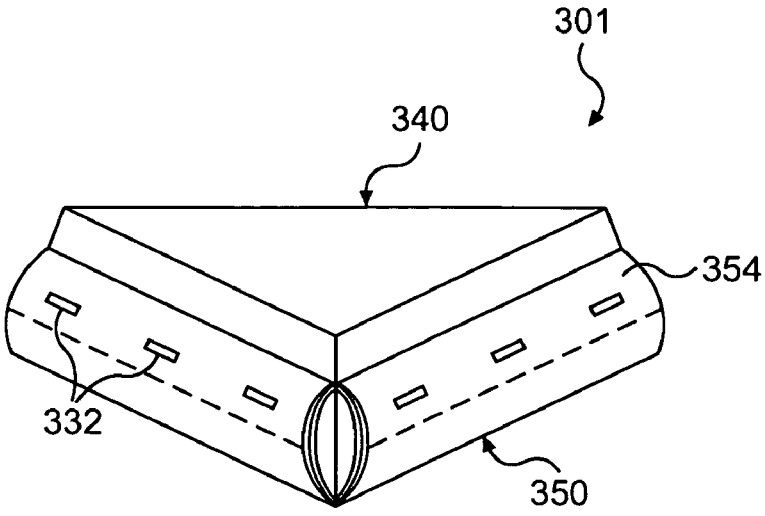
FIG. 17 is a perspective view of an implement according to a fourth embodiment of the invention.
Figure 18:
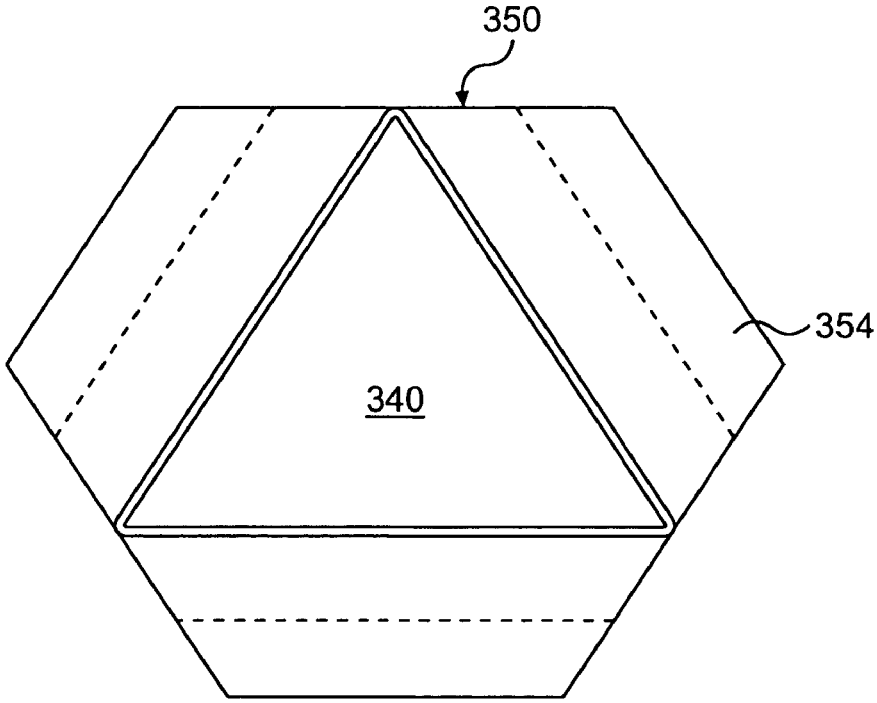
FIG. 18 is a plan view of the implement of the fourth embodiment in a partially disassembled condition.

In some circumstances, such as when cleaning a surface covered with standing liquid or grime, it may be desirable that the sheets of material wrap up on all peripheral edges of the cleaning implement, to prevent the inner sheets of material from becoming soiled at the edges before the outer sheet is removed. That is, edges of each of the plurality of sheets wrap up onto a peripheral sidewall of the handle substantially all the way around the outer periphery of the handle. Such an embodiment is illustrated in FIGS. 17 and 18. In this embodiment, a cleaning implement 301 is provided that comprises a handle 340 and a stack of a plurality of sheets 350 similar to those described in the foregoing embodiments. However, in this embodiment, the sheets 350 wrap around the handle 340 on all peripheral sides, so that the inner sheets are substantially prevented from becoming soiled before the outer sheet is removed.

In particular, FIG. 18 depicts a handle 340 having a substantially triangular outer periphery, placed on top of a stack of sheets of material 350. The sheets of material 350 are in the shape of triangles having their corners removed. The three sides of each sheet 350 extend beyond the three sides of the triangular base 340, such that they can be folded up and attached to the three sides of the handle 340 by a suitable fastening means, such as staples 332, as shown in FIG. 17. Of course, the sheets 350 could be removably attached to the implement in any of the previously mentioned manners, such as by adhesive, rivet, or the like. In this manner, as the cleaning implement 301 is moved across a surface to be cleaned, dirt and grime is substantially prevented from coming into contact with the sheets of material 350, other than the outermost sheet 350. Once the outermost sheet becomes completely soiled or worn, a user can remove the outermost sheet to expose another substantially clean sheet for additional cleaning.

While the triangular shaped handle 340 of this embodiment has some advantages, such as being able to easily get into corners because of its three acute points, this embodiment of our invention is not limited to being triangular in shape. Rather, any other shape of handle is also suitable, as long as the sheets of material are cut so that they can wrap up around substantially the whole perimeter of the handle. For example, the cleaning implement shown in FIGS. 4 and 15 could be modified according to the teachings of this embodiment by extending each of the sheets in the lateral direction, so that the flaps of the sheets can be wrapped up onto and attached to the sides of the handle 40 and 240, respectively. Moreover, the teachings of this embodiment could also be applied to a circular cleaning implement by merely slitting the periphery of the sheets of material in a radial direction to form multiple tabs that could wrap up onto and be attached to the sidewall of such an implement.

The handle of the present invention allows the user to keep his or her hand away from the sheets and the surface to be cleaned, preventing the user's hands from becoming soiled by the surface or bruised by corners and tight spaces. In addition, the handle provides the user a convenient grip that allows the user to apply pressure to the surface to be cleaned, which may improve cleaning performance, especially for grimy surfaces.

While the present invention has been described with respect to several preferred embodiments, these embodiments are provided for illustrative purposes only and are not intended to limit the scope of the invention. In particular, we envision that the various features of the several embodiments of our invention may be combined and modified to suit the needs of a particular application. For example, the dispenser and the implement might be used independently of one another, especially in the case where the sheets are pre-treated by being impregnated with liquid product. In addition, the dispenser assembly of our invention could be adapted to dispense any sort of liquid product onto an implement. Thus, other applications that might benefit from the advantages of our invention include the dispensing of personal products, such as hair gel, mousse, lotion, and the like, household products, such as paint, glue, wax, polishing compound, and the like, as well as numerous other applications.

While each of the foregoing embodiments is described and illustrated with the sheets attached to the handle of the implement with one particular attachment means or another, any suitable attachment means is acceptable, including mechanical means, such as staples, rivets, screws, tacks, stitching, and the like, adhesives, such as pressure-sensitive adhesives, permanent, adhesives, and the like, or any other suitable attachment agent, fastener, or the like.

Although specific components, materials, configurations, arrangements, etc., have been shown and described with reference to several preferred embodiments, the present invention is not limited to these specific examples. One of ordinary skill in the art will realize that various modifications and variations are possible within the spirit and scope of my invention, which is intended to be limited in scope only by the accompanying claims, which should be accorded the broadest interpretation so as to encompass all such modifications, equivalent structures and functions.

INDUSTRIAL APPLICABILITY

The present invention provides, among other things, a compact cleaning dispenser that avoids directly spraying a surface that is to be cleaned, in order to minimize spraying non-targeted areas. In addition, the cleaning dispenser provides a user a convenient grip that allows the user to apply pressure to the surface to be cleaned, which may improve cleaning performance for especially grimy surfaces.

We claim:

1. A dispenser assembly comprising:

a compressible reservoir for holding a liquid product;

a cradle comprising a receiving portion and a base, the receiving portion being pivotally connected to the base, wherein a cavity in the cradle is defined between the receiving portion and the base; the receiving portion comprising:

at least one dispensing aperture for dispensing the liquid product; and a trough formed on the cradle and sloped downwardly away from the at least one dispensing aperture, while the dispenser assembly is in a non-compressed position, wherein the compressible reservoir is disposed in the cavity and is in fluid communication with the at least one dispensing aperture; and a cleaning implement disposed in the receiving portion of the cradle, the cleaning implement comprising a handle having a plurality of sheets attached thereto, wherein the plurality of sheets faces the cradle, and wherein at least one of the plurality of sheets is releasably attached to the handle;

wherein the trough is formed downwardly to allow flow of the liquid product away from the at least one dispensing aperture to wet the cleaning implement; and wherein, when the receiving portion is pivoted toward the base, the compressible reservoir is compressed between the receiving portion and the base, thereby expelling the liquid product from the at least one dispensing aperture.

2. The dispenser assembly of claim 1, wherein the cradle comprises a material selected from the group consisting of polyethylene, polypropylene, styrene, and acrylonitrile butadiene styrene.

3. The dispenser assembly of claim 1, wherein the cradle further comprises a latch mechanism for latching the receiving portion and the base in a folded position, such that the compressible reservoir is enclosed, and such that the ability of the receiving portion to pivot relative to the base is limited.

4. The dispenser assembly of claim 1, further comprising a plug disposed in the at least one dispensing aperture to seal the liquid product in the compressible reservoir during shipping.

5. The dispenser assembly of claim 1, wherein the cradle further comprises a pair of generally upright sidewalls, which at least partially define a receptacle for locating an implement.

6. The dispenser assembly of claim 5, wherein the cradle further comprises a substantially upright end wall, which further defines the receptacle.

7. The dispenser assembly of claim 1, wherein the handle comprises a polyurethane foam block.

8. The dispenser assembly of claim 1, wherein each of the plurality of sheets includes a microfiber mat, including fibers having a diameter no greater than about one micron.

9. The dispenser assembly of claim 8, wherein the microfiber mat includes fibers selected from the group consisting of polyester fibers, nylon fibers, and polyethylene fibers.

10. The dispenser assembly of claim 8, wherein the microfiber mat includes cellulose fibers.

11. The dispenser assembly of claim 8, wherein each of the plurality of sheets further includes a liquid-impenetrable layer.

12. The dispenser assembly of claim 1, wherein the plurality of sheets includes at least one sheet having a microfiber mat and at least one liquid-impenetrable sheet.

13. The dispenser assembly of claim 1, wherein each of the plurality of sheets includes a main body and a pair of tabs, the main body being separated from each of the tabs by a perforation, and each tab being attached to the handle by mechanical means.

14. The dispenser assembly of claim 13, wherein the perforation comprises a first line of die cuts and a second line of die cuts, the second line of die cuts being parallel to the first line, but staggered relative thereto.

15. The dispenser assembly of claim 1, wherein the liquid product comprises a material selected from the group consisting of all-purpose cleaners, furniture cleaners, bathroom cleaners, and glass cleaners.

16. The dispenser assembly of claim 1, wherein the liquid product comprises glass cleaner.

* * * * *